US005524885A

United States Patent [19]

Heo

[11] Patent Number: 5,524,885

[45] Date of Patent: Jun. 11, 1996

[54] TERRY CLOTH GOLF CLUB GRIP

[76] Inventor: Yeong K. Heo, 92-40 53rd Ave., #3, Elmhurst, N.Y. 11373

[21] Appl. No.: 408,355

[22] Filed: Mar. 22, 1995

[51] Int. Cl.[6] ..... A63B 49/08

[52] U.S. Cl. ..... 473/299; 273/75; 473/300; 473/298

[58] Field of Search ..... 273/81 R, 81 B, 273/81 D, 165, 75, 67DB

[56] References Cited

U.S. PATENT DOCUMENTS

| | | | |
|---|---|---|---|
| 1,447,989 | 3/1923 | Kinsman . | |
| 1,617,972 | 2/1927 | Wallace . | |
| 2,459,996 | 1/1949 | Duncan, Jr. . | |
| 3,087,729 | 4/1963 | Sullivan . | |
| 3,147,012 | 9/1964 | Sullivan, Jr. . | |
| 3,606,326 | 9/1971 | Sparks et al. . | |
| 3,614,100 | 10/1971 | Spitz | 273/81 D |
| 4,133,529 | 1/1979 | Gambino | 273/81 R |
| 4,912,836 | 4/1990 | Avetoom | 273/81 R |
| 5,118,107 | 6/1992 | Bucher | 273/81 R |
| 5,134,008 | 7/1992 | Alm | 273/81 R |

FOREIGN PATENT DOCUMENTS

| | | |
|---|---|---|
| 566538 | 2/1924 | France . |
| 3892 | of 1892 | United Kingdom . |

OTHER PUBLICATIONS

The Sporting Goods Dealer, "Product Review," 1974.

*Primary Examiner*—William M. Pierce
*Attorney, Agent, or Firm*—Richard C. Litman

[57] ABSTRACT

A slip-on grip with a main thin rubber cylindrical tube and an outer fabric layer dimensioned to fit securely over an existing grip. The outer fabric layer has longitudinal slits along its lower portion of the rubber tube to allow the tube to expand to slide over the existing golf grip during installation. The outer layer is made of cotton or terry cloth or similar material and is integral with the thin rubber tube to provide a non-slip, gripping surface. In a second embodiment, the golf grip has an additional, thickened interior rubber portion which replaces, instead of slipping over, the existing grip. The grip has the combined function of the existing grip and the grip cover providing a grip wide enough to fit in the palm of an adult's hand.

6 Claims, 7 Drawing Sheets

TERRY CLOTH GOLF CLUB GRIP

BACKGROUND OF THE INVENTION

1. Field of the Invention

The present invention relates to improved golf club grips.

2. Description of the Prior Art

The sport of golf, more than almost any other sport, relies on a player's absolute control of the golf club as a predicate for hitting an accurate shot. Golf is a technical game which requires that a player swing the golf club at nearly 120 miles per hour and contact a two inch diameter ball with uncanny precision. If the golf club approaches the ball with the face of the club at an angle to the ball, a slice or a hook can result, sending the golf ball to the right of left of the desired target. As an example, a shot which carries 200 yards, but slices 8° to the right, may end up more than 27 yards off target in a possibly precarious position. With most greens and long fairways on the golf course being surrounded by sand traps, water, or other hazards, even 10 yards or less can mean the difference between reaching the green and landing in a hazard. Further considering that the object of the stroke is to sink the 2 inch diameter ball in a hole less than 6 inches in diameter, this margin of error can have a devastating impact on the golfer's score.

The focus of a majority of the golf inventions is to reduce this margin of error without sacrificing distance. One persistent source of error that has been recognized is slippage or rotation of the golf club in the hands of the golfer. Over the years, players and especially manufacturers have attempted to provide a more secure and "natural" method of holding the golf club to reduce the chance of the golf club slipping. Manufacturers have introduced "tacky" materials which spray on or coat the golf club to provide a non-slip surface. Others have tried a variety of shapes, sizes, and profiles of golf grips to allow the golfer to securely grip the club.

A majority of the golfers today also wear a golf glove on their left hand (for right-handers) made of a wide variety of materials from leather to high tech synthetic leathers. The gloves provide both a non-slip surface and reduce the stress on the hands to prevent blisters. The main drawbacks to gloves have been the extra equipment required to be carried and the limited life of the gloves. In addition, a poorly fitting glove that is too large or too small will reduce the player's gripping ability.

The effectiveness of all of these prior inventions has been limited, and have been ineffective in rainy or wet conditions.

One such attempt to improve the existing grip on a golf club is seen in U.S. Pat. No. 3,087,729 issued to Sullivan on Apr. 30, 1963, which shows a slip-on grip for a golf club, with an outer wrap of leather or plastic. The slip-on grip decreases the time and skill required to change the golf grip.

U.S. Pat. No. 3,606,326 issued to Sparks et al. on Sep. 20, 1971, shows a superimposed foamed sponge elastomer grip for a golf club to provide a "non-slip" grip.

British Patent No. 3892 published on Feb. 29, 1892, shows a spongy rubber cover with a wool or felt outer layer to absorb perspiration and reduce shock. The cover is used on hand tools for similar articles.

U.S. Pat. No. 1,617,972 issued to Wallace on Feb. 15, 1927, shows an easy application grip which is secured to the golf club by a zipper. The exterior of the grip is made of a cotton fabric weave to provide a "roughness" to the grip to make the grip easier to securely grasp. A separate embodiment uses a seamless tube with a similar cotton fabric on the exterior surfaces.

The use of a terry cloth grip that slips over the existing grip of a tennis racket is disclosed in *The Sporting Goods Dealer*, published in 1974. The terry cloth grip absorbs perspiration and reduces deterioration of the existing leather grip.

U.S. Pat. No. 3,147,012 issued to Sullivan, Jr. on Sep. 1, 1964, shows a slip resistant grip for snapping on top of the existing grip. The slip resistant grip has two elastic bands with a length of fabric draped between.

U.S. Pat. No. 1,447,989 issued to Kinsman on Mar. 13, 1923, shows an improved grip having a thickened wrap applied around its circumference. An annular gap is formed on the grip to improve the fit of the grip with the hands.

French Patent No. 566,538 published Feb. 15, 1924, shows a rubber material which can be attached to a sports instrument or a tool to improve the gripping surface.

None of the above inventions and patents, taken either singly or in combination, is seen to describe the instant invention as claimed.

SUMMARY OF THE INVENTION

The present invention proposes a novel and improved golf grip which overcomes the shortcomings of the prior inventions. The golf grip according to the present invention provides a slip-on grip with a main thin rubber cylindrical tube dimensioned to fit securely over an existing grip. The lower portion of the rubber tube expands to slide over the existing golf grip during installation. Once in place, a circumferential elastic band seats the end of the tube against the shaft of the club. A cotton outer layer of terry cloth or similar material, integral with the thin rubber tube provides a non-slip gripping surface. The terry cloth has a plurality of longitudinal slits to allow the cotton layer to expand with the rubber layer. The grip easily slips over the existing grip to form a soft, moisture absorbent grip which can be used without the necessity of a golf glove.

The interior surface of the rubber layer has stipples or protruding pyramidal patterns to prevent the grip from slipping or rotating about the shaft. The stipples are more concentrated beneath the area where the thumbs of the players hands will contact the grip to provide maximum protection against rotation and slippage.

In a second embodiment according to the present invention, the golf grip has an additional, thickened interior rubber portion which replaces, instead of slipping over, the existing grip. The grip has the combined function of the existing grip and the grip cover providing a grip wide enough to fit in the palm of an adult's hand.

Accordingly, it is a principal object of the invention to provide a slip-on grip with a soft, moisture absorbent outer layer.

It is another object of the invention to provide a grip cover which will allow a golfer to comfortably and securely hold a golf club without using a golf glove.

It is a further object of the invention to provide a grip with a non-slip outer surface which is useable in wet or rainy conditions without significant performance losses.

Still another object of the invention is to provide a soft, moisture absorbent glove which replaces the existing grip of a golf club.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention relates to a slip-on grip which covers the existing grip of a golf club to provide an enhanced, non-slip gripping surface. Referring now to the figures, a more detailed description of the invention will be made.

Figure 1:
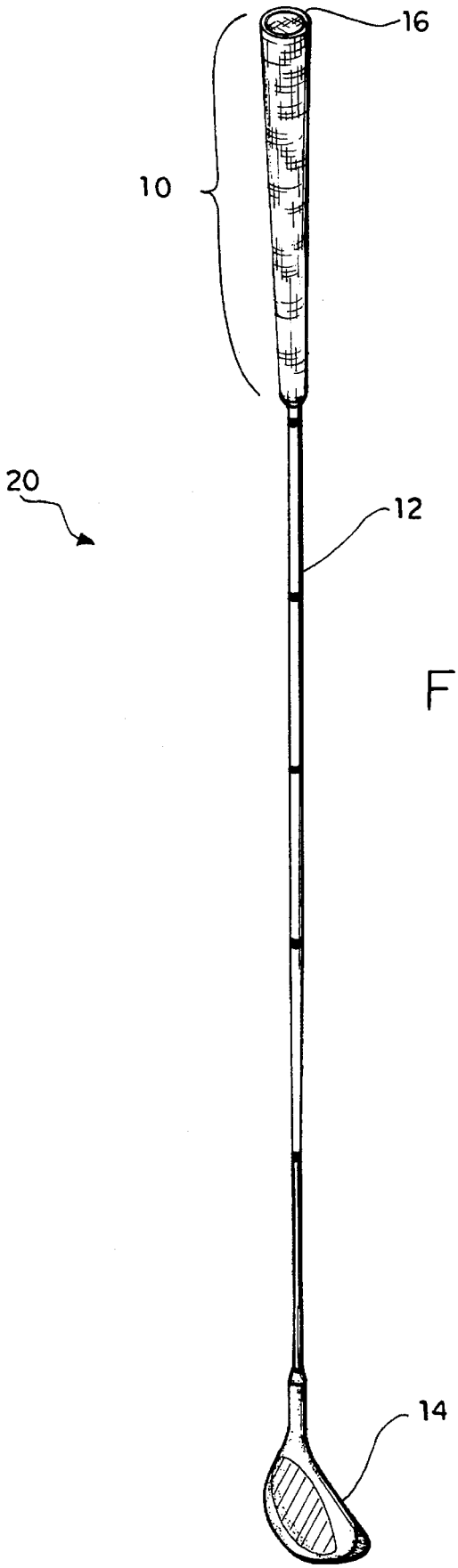
FIG. 1 is a perspective view of a golf grip according to the present invention installed on a golf club.

FIG. 1 shows a grip 10 according to the present invention installed on a golf club 20. The golf club has a shaft portion 12 and a head 14. The shaft can be made of a wide variety of materials currently in use including steel, carbon fiber, titanium and beryllium. The head 14 can be an iron or a wood or a putter, or could as well be an accessory item such as a telescoping ball retriever.

Figure 4:
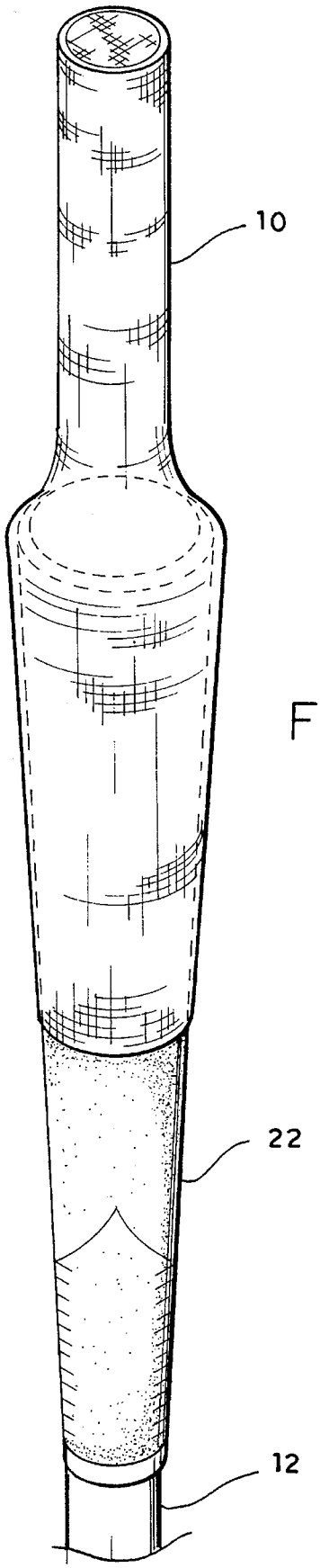
FIG. 4 is a perspective view of the installation of the golf grip according to the first embodiment of the invention.

As best seen in FIG. 4, the golf club 20 has an existing rubber grip 22 which is placed near the butt end 16 of the shaft. The existing grip 22 of the club typically tapers from the butt of the club towards the head of the club to accommodate the hands of the player. During continued play, the grips wear down and become smooth and slippery. The grooves and texture patterns on the grip which prevent the club from slipping in the hands of the player wear down, reducing their effectiveness. Additionally, the current grip may be unsatisfactory in wet condition, as the rubber becomes slippery as water builds up on the exterior surface of the existing grip. This "play" in the grips can offset the accuracy of a player to produce inconsistent blade angles as the club head approaches the ball, sending the ball well left or right of the target.

By using a grip with a water absorbent material on the outer surface of the grip, a greater control can be maintained over the club even in wet or rainy conditions. In addition, by choosing a softer material for the outside of the grip, the function of both the grip and the golf glove can be combined into the grip, eliminating a potential source of inaccuracy.

Figure 2:
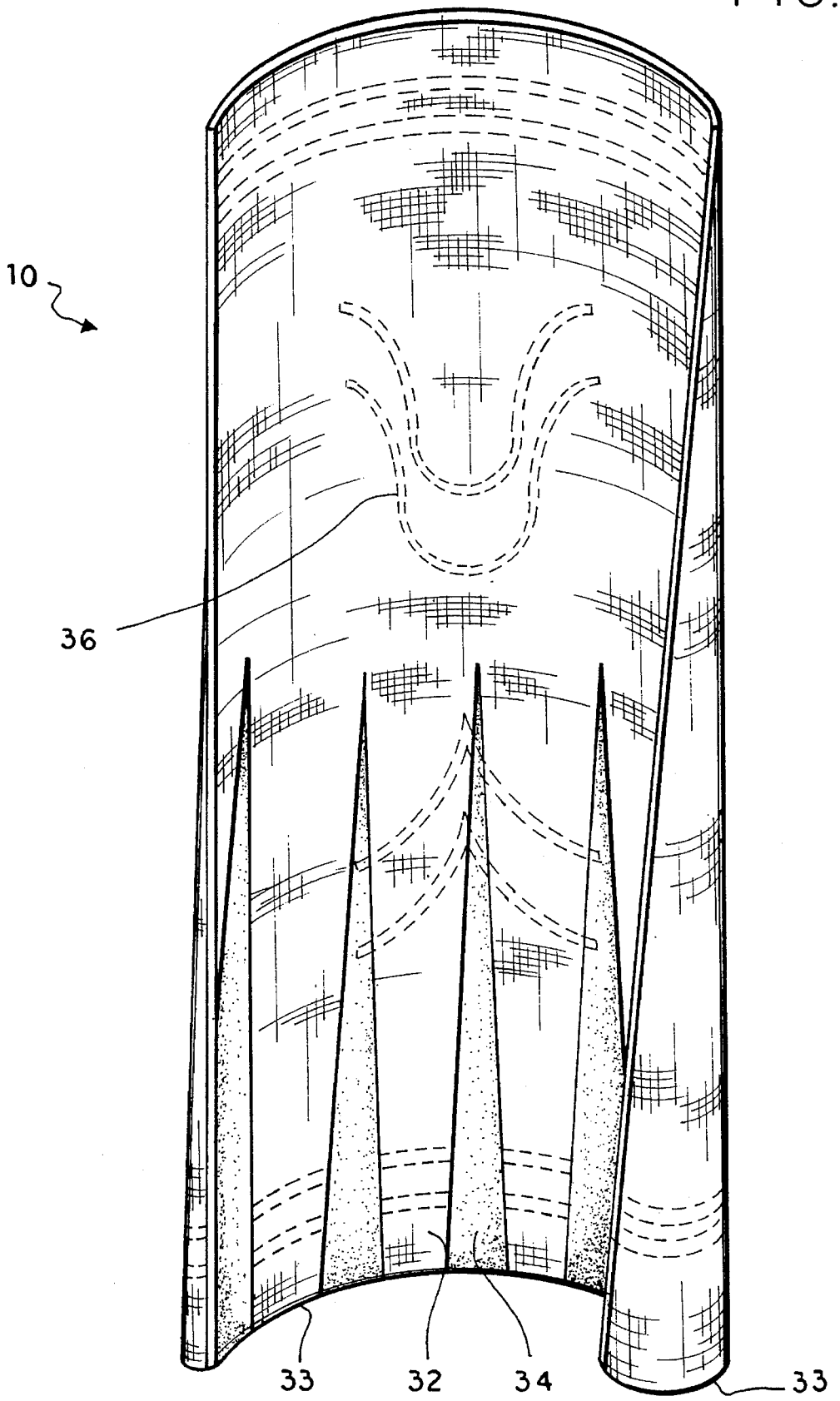
FIG. 2 is a break away view of the golf grip according to a first embodiment of the invention, drawn to an enlarged scale.
Figure 3:
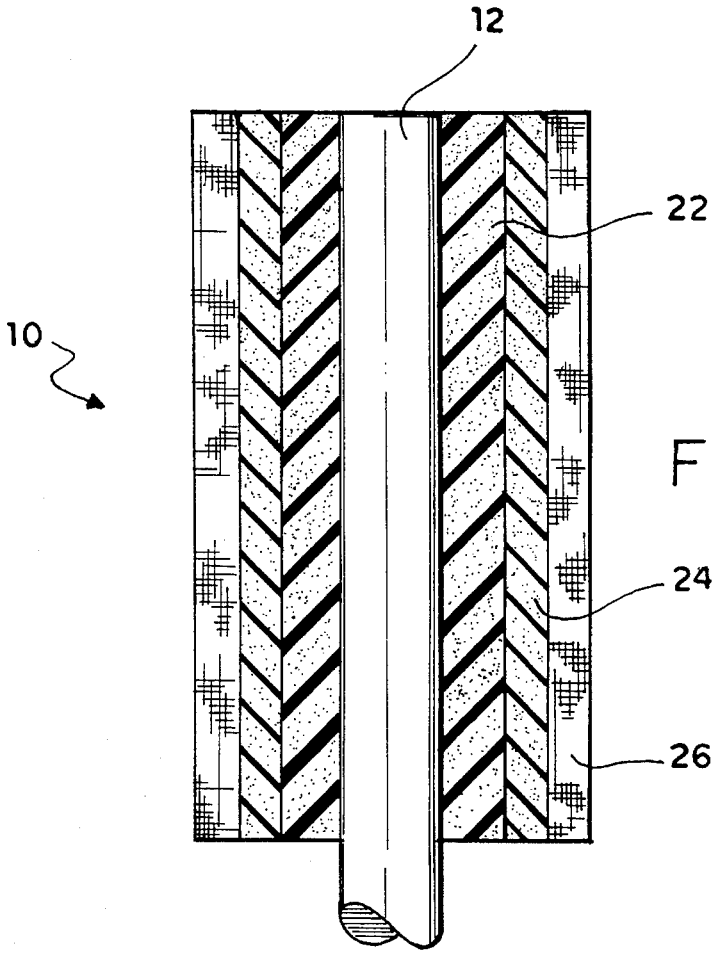
FIG. 3 is a cross-sectional view of the golf grip according to the first embodiment of the invention.
Figure 5:
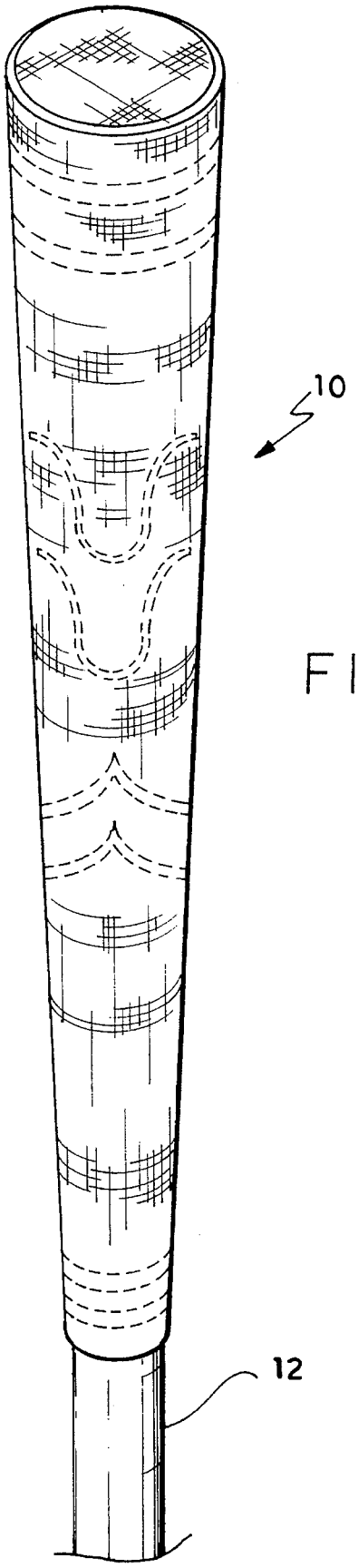
FIG. 5 is a detailed perspective view of the golf grip according to the first embodiment of the invention.

As best shown in FIGS. 2, 3, and 5, the slip-on golf grip 10 according to the present invention has a cylindrical thin rubber layer 24 and tapers from the largest end at the butt 16 of the shaft towards the head 14 of the club. The slight taper generally matches the taper of the golf club, but the taper can be greater or less to emphasize or de-emphasize the taper of the club.

The grip 10 is manufactured with an outer covering, fabric layer 26 integral with the rubber layer 24 to absorb perspiration and moisture. The fabric can be selected from a great many materials including, but not limited to, terry cloth, cotton, wool, rayon, or felt. The fabric provides a comfortable and firm gripping surface to allow a player to maintain firm control of the club. The use of a high pile fabric on the club provides a grip that is comfortable enough to be used without a glove, to replace the combination of a normal grip and a golf glove.

The lower end of the grip expands to slide over the existing golf grip 22 during installation. Once in place, a circumferential elastic band 33 (best shown in FIG. 2) secures the end of the grip 10 against the existing grip 22 or shaft of the club 12 (see FIG. 4). The terry cloth layer 26 of the grip has longitudinal slits 32 between cloth panels 34 to allow the terry cloth to expand in conjunction with the rubber portion of the grip. Once installed, the panels piece together to form a continuous circumference of fabric providing a smoothly tapering grip with fabric material along the entire length of the grip.

To facilitate installation, a liquid or spray which acts as a lubricant/adhesive is applied to the interior surface of the grip to allow the slip-on grip 10 to slide smoothly over the existing grip 22 and to affix the slip-on grip 10 in place when the lubricant/adhesive dries. The use of lubricant/adhesives for installing golf grips is well-known in the art.

Figure 8:
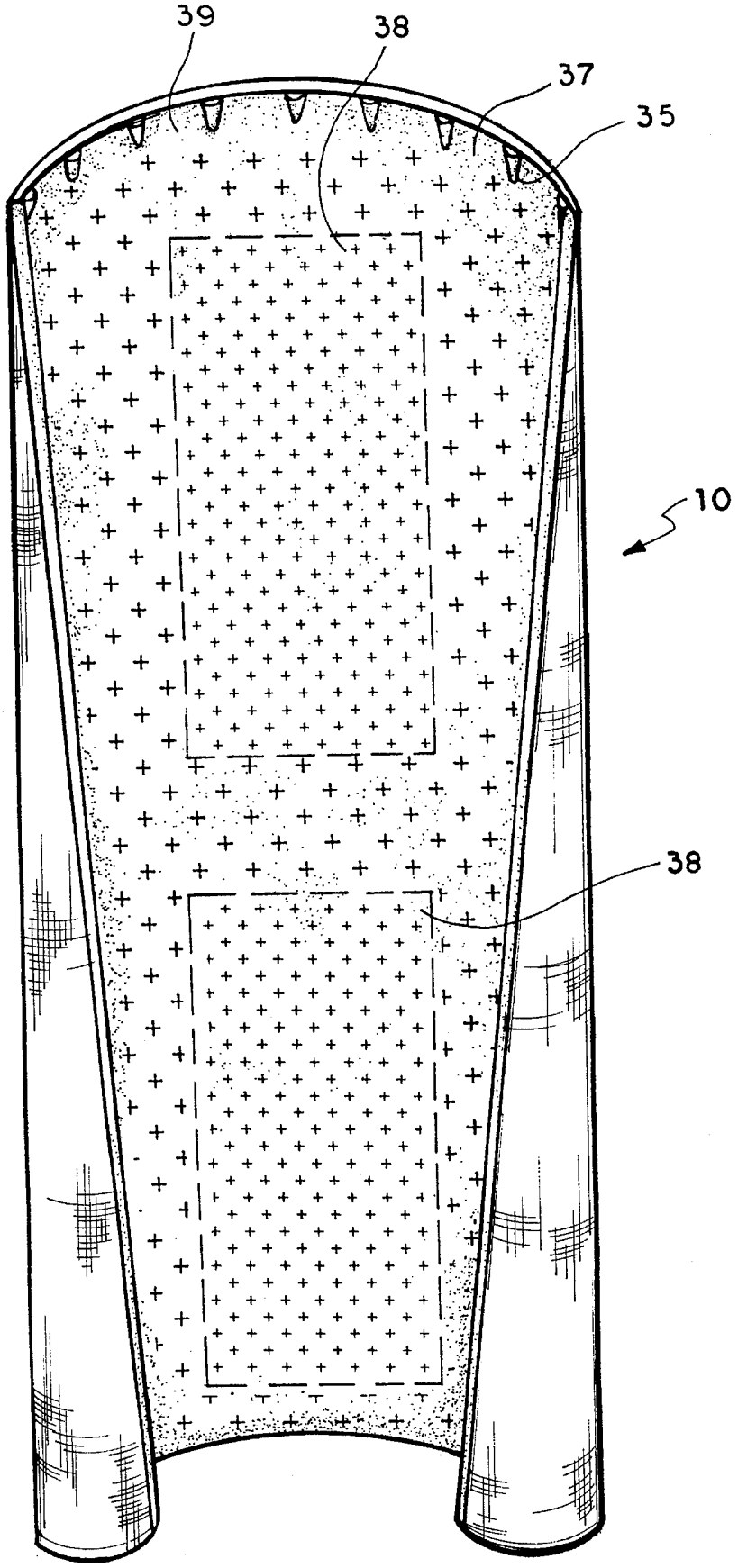
FIG. 8 is a break away view of the golf grip interior surface according to the invention, drawn to an enlarged scale.

As seen in FIG. 8, the interior surface 37 of the rubber later has stipples 39 or protruding pyramidal patterns to prevent the grip from slipping or rotating about the shaft. The stipples are more concentrated beneath the area 38 where the thumbs of the players hands will contact the grip to provide maximum protection against rotation and slippage. Extra folds of material 35 are provided at the top of the grip to allow the grip to expand to fit over the butt of the existing grip.

Figure 6:
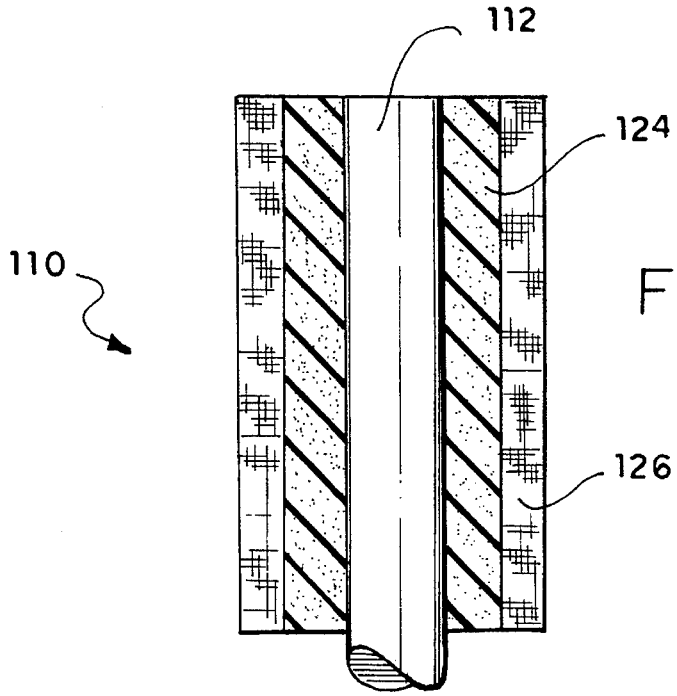
FIG. 6 is a cross-sectional view of a golf grip according to a second embodiment of the invention.

In a second embodiment shown in FIG. 6, the grip 110 is similar to the first embodiment, but incorporates the function of both the existing grip 22 (see FIG. 4) and the slip-on grip. The thin rubber portion 24 (see FIG. 3 of the slip-on grip has been supplemented to form a more substantial rubber layer 124. The extra material provides cushion against the shock produced during play, and widens the grip 110 to accommodate the hands of an adult. A moisture absorbent material 126 surrounds the rubber layer 24 in the same manner described above with reference to the first embodiment. The fabric of the moisture absorbent layer 126 extends the entire length of the rubber layer 124. The terry cloth portion 126 of the grip 110 does not require that slits be cut along its length because only minimal expansion of the grip 110 is required during installation over the thin golf club shaft 112.

While the grip of the second embodiment is shown preferably to be made of one layer of rubber 124, the grip may also be made of two layers of disparate types of rubber resulting in a cross-section as shown in FIG. 3 for the first embodiment. A substantial difference between the second embodiment and the first embodiment is that the inner layer 22 can be made of a material other than a prior art grip. The multi-layer grip may also be formed as a one piece unit. It is possible to bond the layers of rubber and fabric together to form an integral, one-piece grip for use as an original equipment grip or an easily installed, after market grip. The slitted panels 32,34 are provided as shown in FIG. 2 to facilitate expansion of the grip during insertion on to the shaft of the golf club. One skilled in the art would recognized that because the two layers of rubber are being inserted on the golf club shaft 12 simultaneously, the outer layer 24 does not have to be stretched over the inner layer 22 during installation, the grip may also be made without slits to reduce production costs, etc.

Figure 7:
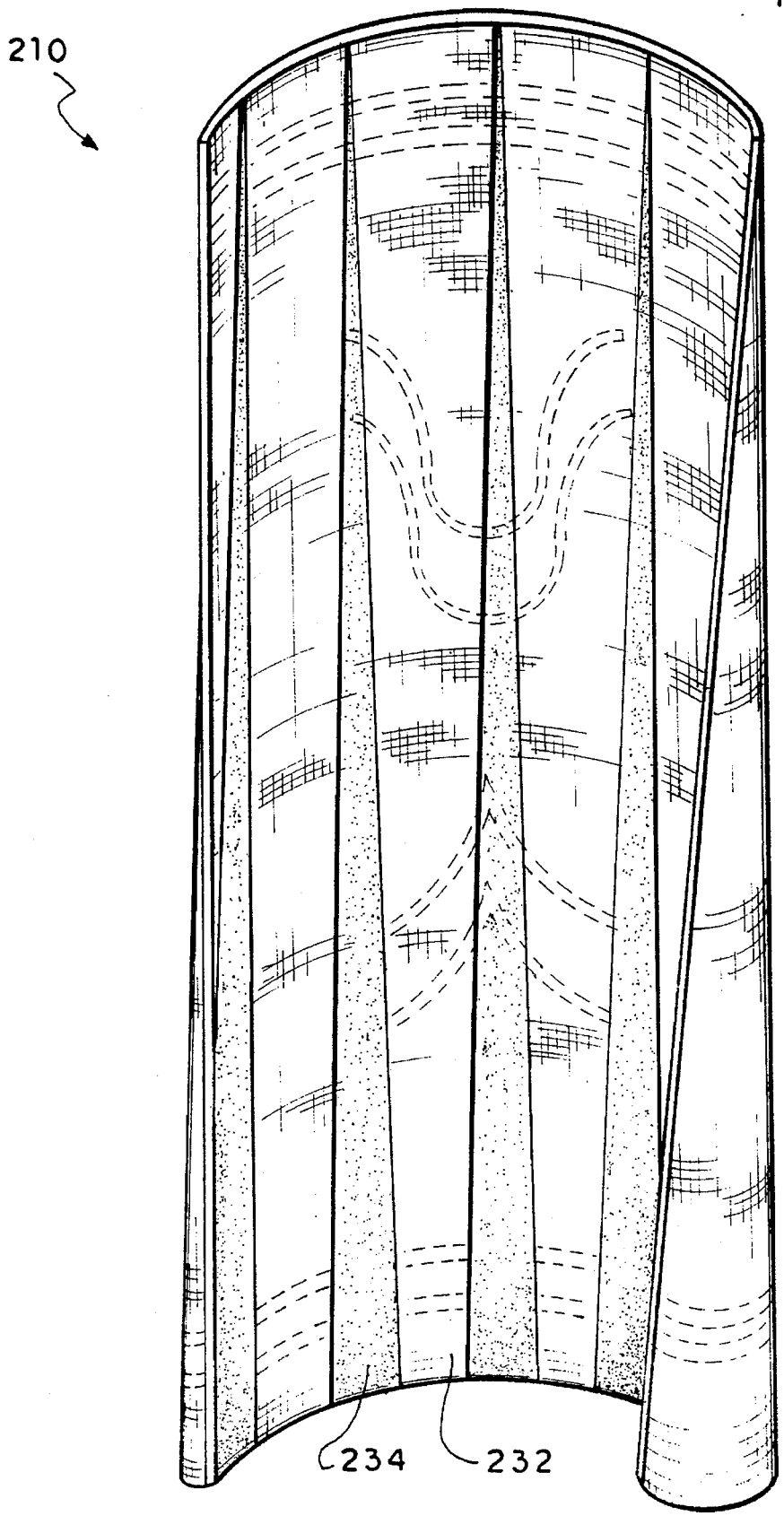
FIG. 7 is a break away view of the golf grip according to a third embodiment of the invention, drawn to an enlarged scale.

In a third embodiment as shown in FIG. 7, the golf grip 210 has slits 232, 234 extending the entire length of the terry cloth portion of the golf grip. The extra length of the longitudinal slits provides for a more secure fit of the grip on to the golf club by allowing more of the grip to contract or expand to fit the profile of the grip. This has been found to be especially important since the top portion of prior art grips tend to be a great deal wider than the lower portion of the grips. The extra slit length also reduces the stress on the upper part of the grip, thereby extending the life expectancy of the grip. In addition, the longer slitted grip has a more uniform fit with the hands of the user because the entire grip is allowed to contract around the golf club.

It is envisioned that the grip 110 of the second embodiment would be installed as original equipment on golf clubs, or sold separately to replace ripped or worn grips. The slip-on grip 10 of the first embodiment can be sold individually or in sets for after market installation onto golf clubs.

It is further envisioned that the construction of the grip could be modified for use on the shaft or handle of various other sporting goods and tool, including, but not limited to tennis rackets, racquetball rackets, fishing rods, pliers, and hammers, which would be enhanced by improved gripping surfaces.

Accordingly, it is to be understood that the concepts disclosed herein are not limited to the embodiments described above, but encompasses any and all embodiments within the scope of the following claims.

I claim:

1. A slip-on grip for attaching over an existing grip of a golf club, comprising:

a generally cylindrical, elastomeric tube having a closed end and an open end, said elastomeric tube having a point intermediate said closed end and said open end; and an outer covering integral with said elastomeric tube, said outer covering having a plurality of longitudinal slits defining a plurality of panels between said slits, said slits extending from said open end to said intermediate point of said elastomeric tube.

2. The slip-on grip according to claim 1, wherein said outer covering comprises a fabric layer attached to said elastomeric tube and extending the length of said elastomeric tube.

3. The slip-on grip according to claim 2, wherein said elastomeric tube tapers from said closed end to said open end.

4. The slip-on grip according to claim 2, wherein said fabric layer is made of terry cloth.

5. The slip-on grip according to claim 2, wherein said fabric layer is made of wool.

6. The slip-on grip according to claim 2, wherein said fabric is made of cotton.

* * * * *